United States Patent [19]

Grandinetti

[11] Patent Number: 4,711,479

[45] Date of Patent: Dec. 8, 1987

[54] PIVOTING BAR LOCK

[76] Inventor: Paul M. Grandinetti, 4797 Ellery Dr., Columbus, Ohio 43227

[21] Appl. No.: 696,118

[22] Filed: Jan. 29, 1985

[51] Int. Cl.[4] ..... E05C 17/20

[52] U.S. Cl. ..... 292/272

[58] Field of Search ..... 292/259, 268, 272, 263, 292/271, DIG. 32

[56] References Cited

U.S. PATENT DOCUMENTS

| | | | |
|---|---|---|---|
| 1,661,706 | 3/1928 | Schobert et al. | 292/272 |
| 3,924,885 | 12/1975 | Markovitch | 292/263 |
| 3,924,886 | 12/1975 | Markovitch | 292/262 |
| 3,980,330 | 9/1976 | Walker | 292/262 |

*Primary Examiner*—Richard E. Moore

*Attorney, Agent, or Firm*—Fisher, Christen & Sabol

[57] ABSTRACT

This invention discloses a pivoting bar lock which has a locking bar guide slidably attached to a locking bar. The locking bar is pivotally attached to a mount or base plate which is affixed to a door jambb. The locking bar guide can be inserted into or slid through a mount or other means of a door mount retainer assembly mounted on a door. The door can thus be locked in a fully closed position or allowed to be partially opened while remaining securely locked. The locking bar can be used to apply leverage to close the door against the force of an intruder.

9 Claims, 8 Drawing Figures

PIVOTING BAR LOCK

BACKGROUND OF THE INVENTION

1. Field of the Invention

This invention relates to locks which allow a door to be partially opened without being unlocked. More particularly, this invention relates to a bar lock which allows a door to be partially opened while remaining locked and can be used as a lever to force the door closed.

2. Description of the Prior Art

The prior art includes numerous lock devices which permit a door to be partially opened while still remaining locked. Examples include structures ranging from the common chain lock to various sliding clasp locks.

U.S. Pat. No. 3,980,330 to Walker shows a device with a rotatable clasp on the door jamb which fits over and between a slidable bar on the door face. This safety latch will allow a door to be held in the lock position or in a partially opened position. This lock has 2 plates in which a sliding bolt is inserted. One plate holds the plate closed; the other plate will allow the door to be partially opened.

U.S. Pat. No. 3,924,885 to Markovitch is a safety latch with a rotatable clasp, which disengages from the hinge to allow the door to be opened. The latch in this invention is telescopic. A T-shaped engagement nose slides in a slot within a link. When the link is fully extended and the T-shaped nose is at the end of the link the door is held partially open but firmly locked.

U.S. Pat. No. 3,924,886 to Markovitch, discloses a safety latch with a rotatable clasp which is hinged in the middle and which comes apart in the middle of the clasp. A latch link and an intermediate link are folded into a base and slide to a non-engagement position. They may also be slid to a position where a latch link is engaged with a latch plate and the links can unfold to permit the door to open to a limited position.

U.S. Pat. No. 1,661,706 to Schobert et al., shows a clasp which fits in a grooved slide in a retainer on the door face.

The prior art fails to provide a simple lock device wherein a solid locking bar can be used to hold the door in a fully closed position, a partially open position, and also be used as a lever to help close the door against one who is attempting to force his way in.

SUMMARY OF THE INVENTION

This invention is a pivoting bar lock comprising a door mount retainer and a means for locking and applying leverage to close a door. The means to lock and apply leverage is rotatably affixed at a first end to a jamb of the door and removably affixed at a second end to the door mount retainer. The means to lock and apply leverage can be a locking bar and a locking bar guide slidably affixed on the locking bar.

The preferred embodiment of this invention has a solid locking bar mounted to its based plate on a door jamb. Slidably mounted on the locking bar is a latching device or locking bar guide. This bar guide can be slipped into a retainer mounted on a door. The bar guide can slide into a position on the door mount retainer, which will not permit the door to be opened. It can also be put in a position that will allow the door to be partially opened. When the door is partially opened the bar guide will still slide up and down the length of the locking bar. With the door partially opened, the bar guide will remain at the terminal end closest to the door jamb of the mounted retainer as the door is being closed. The bar guide will slide down the length of the solid locking bar. As the bar guide slides down the bar, the bar becomes a lever to help force the door to a closed position.

DETAILED DESCRIPTION OF THE INVENTION

This invention includes four major components. The most important of these components is a solid locking bar which in the preferred embodiment is mounted in a rotatable manner to a base plate which is securely attached to a door jamb. Slidably mounted on this locking bar is a locking bar guide. The locking bar guide can slide along the length of the locking bar. The locking bar guide is not removable in the preferred embodiment. The base plate prevents the removal of the bar guide at one end of the locking bar and in the preferred embodiment a "T" shaped head prevents the removal of the bar guide at the other end of the locking bar. Alternatives to this invention may include a locking bar guide which is removeable. Other suitable means for maintaining the locking bar guide on the locking bar and preventing its sliding off the terminal end of the bar can be used. A key operated tumble lock that can be included which operates from the outside surface of the door which disengages the locking bar guide (not shown in the figures). The preferred embodiment of the invention includes a door mount retainer. In this embodiment, the door mount retainer has two ends. Down the center of the door mount retainer, there is a channel upon which the locking bar guide slides. On the end most distant from the door jamb is an opening into which the bar guide is slid. At the end nearest to the door jamb are stops which retain the bar guide on the channel of the base plate. Numerous alternatives can be made on the door mount retainer. For example, a "T" shaped rail can be used in which a similiar slot or hole was cut in the locking bar guide (not shown in the figures).

Figure 1:
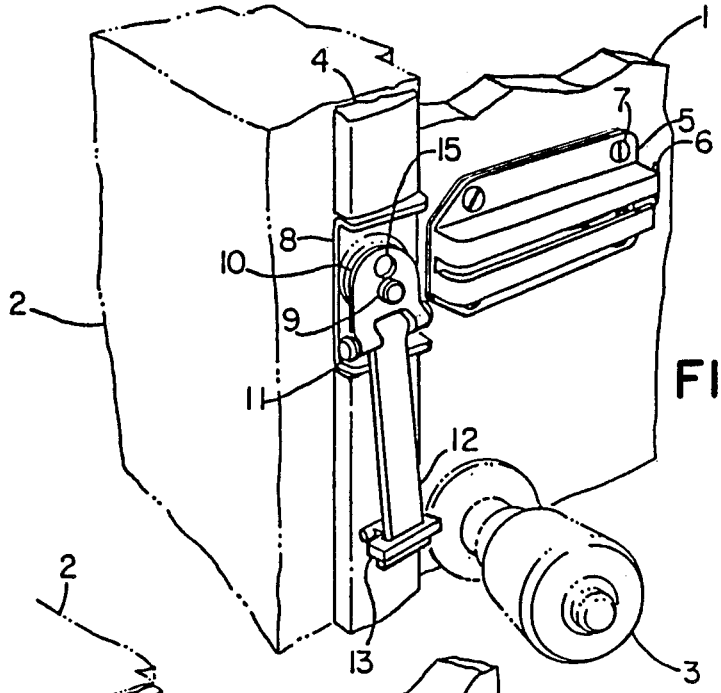
FIG. 1 is a perspective view of the invention in the unlocked position.

Referring to FIG. 1, a door 1 with a door knob 3 is in a closed position against door jamb 2. Down the edge of door jamb 2 there is typically a strip of wood trim 4. In a section cut out of the wood trim 4, a base plate 8 is attached to the door jamb 2. A pivot plate 10 is anchored into the base plate 8 with a rivet 9. The pivot plate 10 has a hole 15 drilled in it at one end such that screw heads can pass through the hole 15 into door jamb 2 to hold base plate 8 securely onto door jamb 2. A locking bar 12 is held onto a pivot plate 10 with a pin 11. The locking bar 12 at the end opposite of the end secured by the pin 11 has a "T" shaped head in the preferred embodiment. In this manner, the bar guide 13 is kept from sliding off either end of the locking bar 12. On the door 1, a door mount retainer 5 is secured to the door by screws 7. At the end of the door mount retainer 5 opposite the door jamb 2 is an opening to a slot into which the bar guide 13 is passed. In the preferred embodiment a steel tension spring 6 must be depressed to allow the bar guide 13 into the slot of the door mount retainer 5. The spring 6 prevents the bar guide 13 from being accidentally slid out of the slot of the door mount retainer 5 or to be removed from the slot by one attempting to break into the door.

Figure 2:
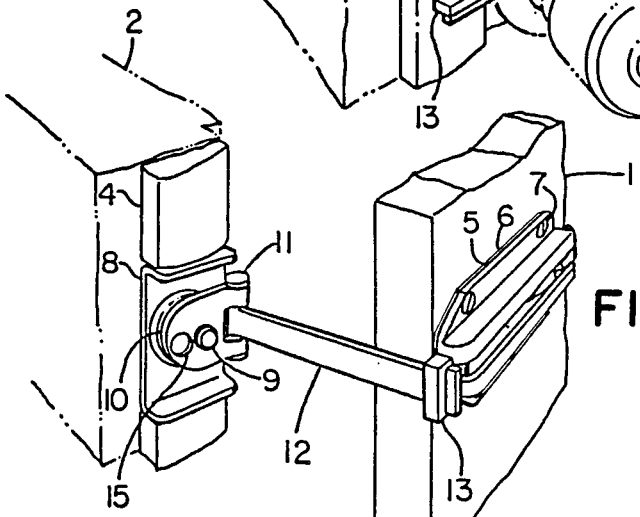
FIG. 2 is a perspective view of the invention holding a door firmly locked yet partially opened.

FIG. 2 shows the same elements present in FIG. 1, but with the door 1 being held in a partially opened position by the locking bar 12 and the bar guide 13 positioned at the terminal end of the "T" shaped head of the locking bar 12.

Figure 3:
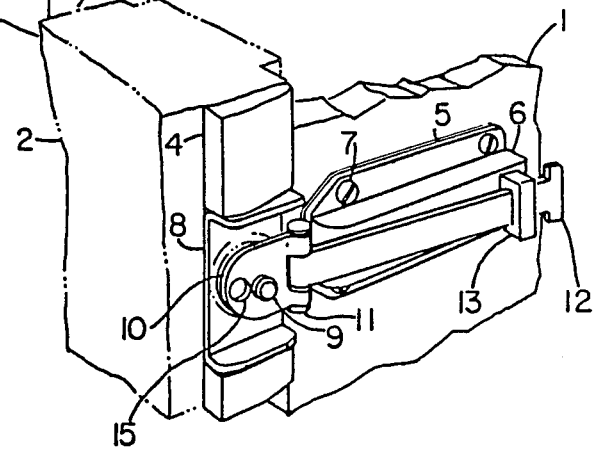
FIG. 3 is a perspective view of the invention holding the door firmly locked and in a fully closed position.

FIG. 3 again shows the same elements, but this time with the door 1 in a closed position and the locking bar 12 extended along the door mount retainer 5 and with the bar guide 13 at both the terminal ends of the locking bar 12 and the door mount retainer 5. The bar guide 13 is being retained in door mount retainer 5 by spring 6.

Figure 4:
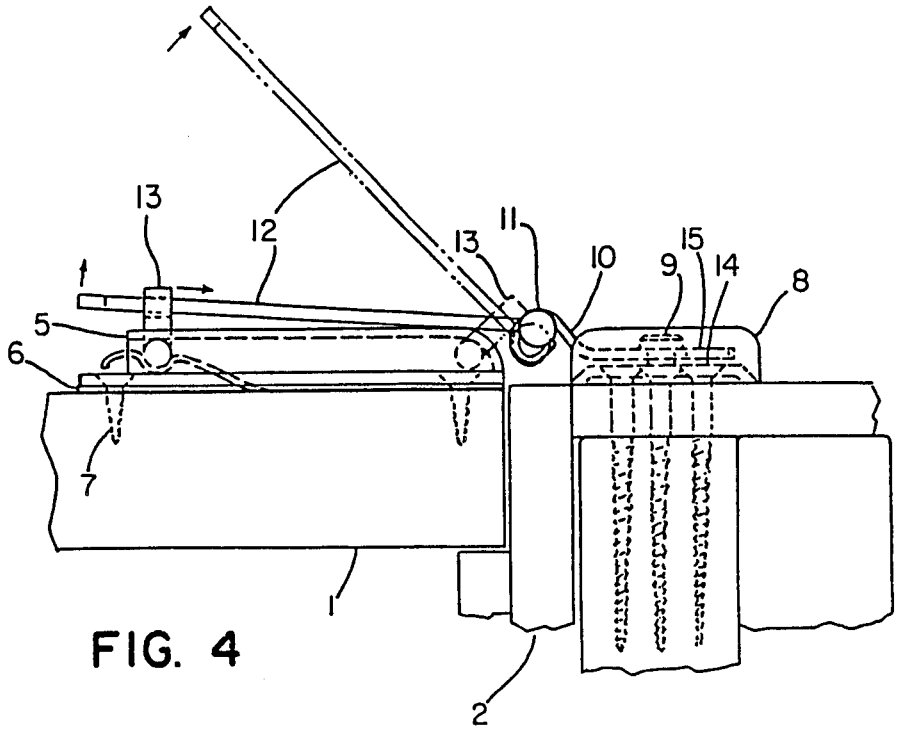
FIG. 4 shows a top plan view of the preferred embodiment of the invention with the locking bar holding the door fully closed and a phantom view of the locking bar in a leverage position.
Figure 5:
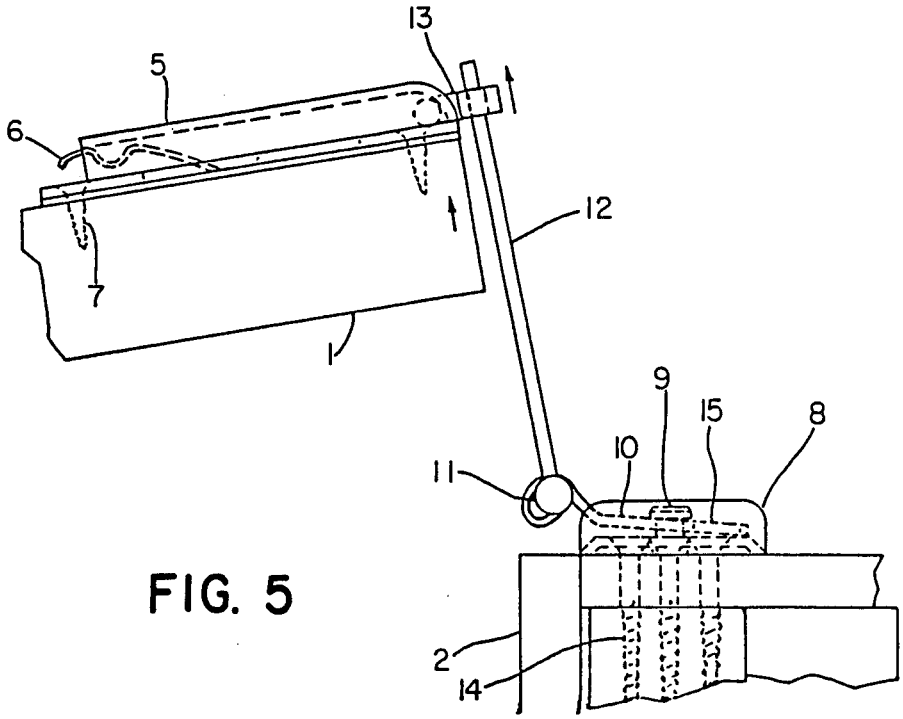
FIG. 5 is a view of the preferred embodiment of the invention holding the door in a partially opened position.

FIG. 4 shows the screw placement of screws 14 into a stud of door jamb 2. The screws 14 are pictured holding the base plate 8 onto the door jamb 2. The locking bar 12 is shown in two positions each of which depict the bar guide 13 within the slot of the door mount retainer 5. The solid line depiction of the locking bar 12 illustrates the bar guide 13 in a position that prevents its exiting from the slot of door mount retainer 5 by the spring 6. The phantom depiction of the locking bar 12 illustrates the bar guide 13 at the end of the door mount retainer 5 closest to the base plate 8. In this position, the door 1 can be opened to the partial opened position illustrated in FIG. 5. As the door is being closed with the bar guide 13 at this end of the door mount retainer 5, the locking bar 12 can be used as a means to apply leverage against the door mount retainer 5 to assist in closing and latching the door against the force of one trying to enter the door. Also illustrated in FIGS. 4 and 5, is the preferred embodiment of screw placement of screws 7 used to hold the door mount retainer 5 onto the door 1.

Figure 6:
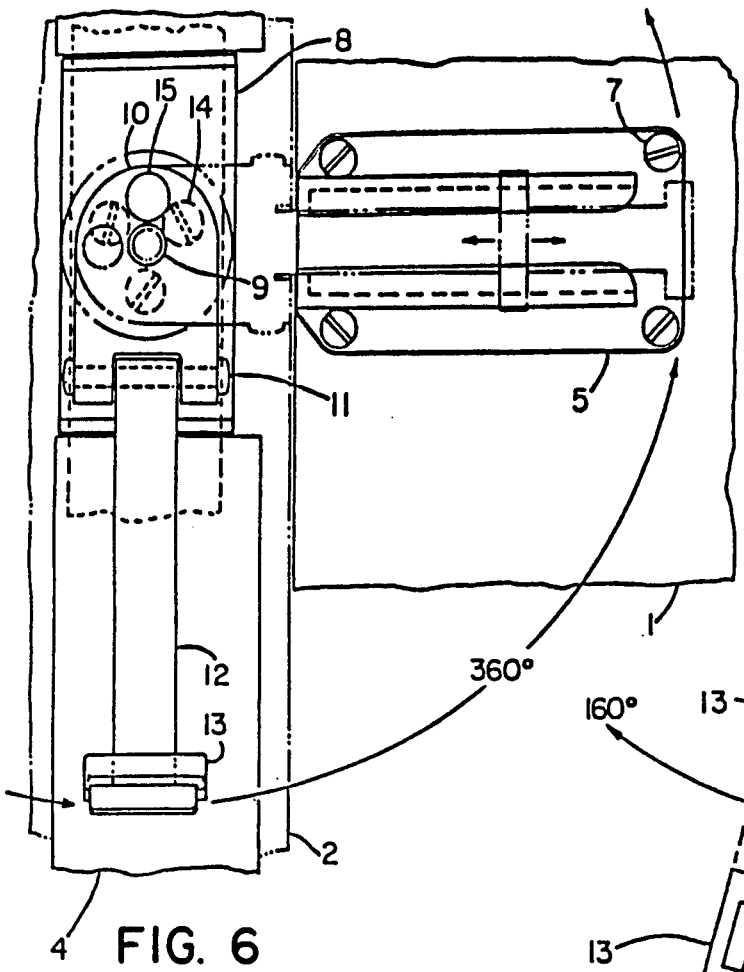
FIG. 6 is a front view of the preferred embodiment of the invention showing the sliding bar in its unlocked, at rest position and a phantom view in in its locked position holding the door fully closed.

FIG. 6 again shows the same elements. In this figure the door 1 is in the closed position against the door jamb 2. This figure illustrates the locking bar 12 in the unlocked position hanging downwardly and away from the trim strip 4 of the door frame by a pin 11, which holds the locking bar 12 onto base plate 8. The phantom view of locking bar 12 shows it in the locked position extended horizontally and parallel to the slot of the door mount retainer 5. In this view the guide bar 13 is in the middle section of the door mount retainer 5. In this position, one attempting to break into the door must apply a greater amount of force than if the locking guide 13 were at the terminal end of the door mount retainer 5 next to the door jamb 2. This is because, when the locking bar guide 13 is in the middle section of the door mount retainer 5, the locking bar 12 itself is held against the door mount retainer 5 and acts as a lever to hold the door 1 shut. In this position, the invention effectively allows the door 1 to be locked by a solid piece of metal, the locking bar 12, in much the same manner as a solid bolt. Note from this figure, that the locking bar 12 mounted on the pivot plate 10 has a pivot means and can swivel around the rivet 9. This allows the locking bar 12 to hang free when not in use and without marring the trim strip 4.

Figure 7:
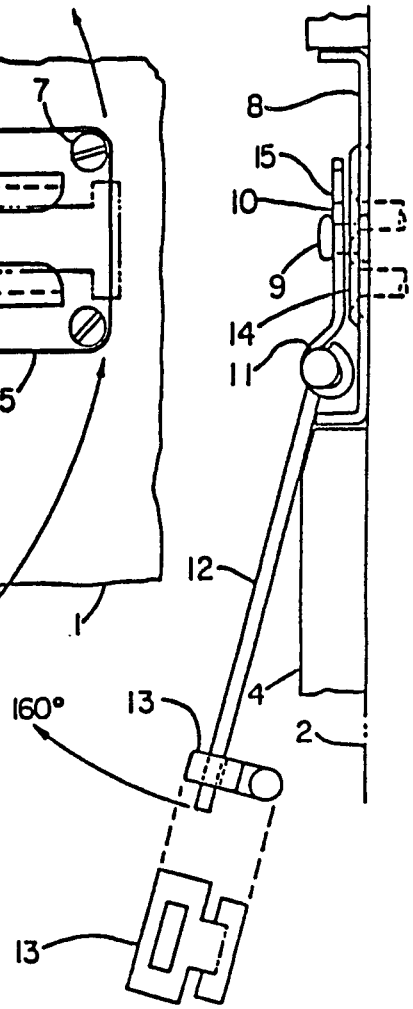
FIG. 7 is a side view illustrating the locking bar guide and it's relationship to the locking bar as well as showing a plan of the locking bar guide.

FIG. 7 illustrates locking bar 12 hanging downwardly from pivot plate 10. In this embodiment the door trim 4 has been shaved slightly to accommodate the locking bar 12 in this position. Alternative embodiments can have the locking bar guide 13 of such a length that it would rest against the door trim 4. FIG. 7 also shows a view of the locking bar guide 13 unassembled from the locking bar 12 with a hole through which the locking bar 12 is passed and a "T" shaped portion. The head of the "T" shaped portion of the bar guide 13 removably slides into the slot of the door mount retainer 5. Note that the locking bar 12 also pivots about the pin 11.

Figure 8:
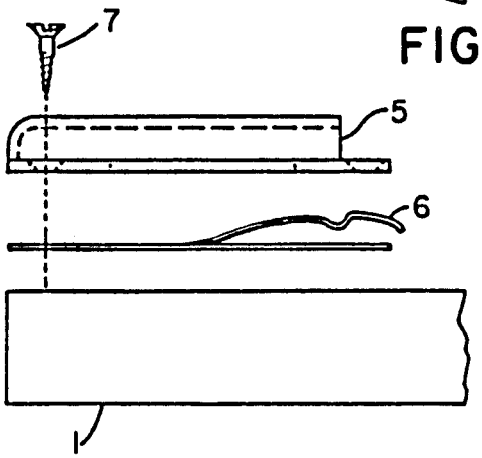
FIG. 8 is a top plan view showing the inter-relationship of the parts making up the door mount retainer assemblage.

FIG. 8 shows the assemblage and individual parts of the door mount retainer assembly 5 with the spring 6 and the screw 7 in their relationship to the door 1.

To place the pivoting bar lock in a "locked position" one lifts and pivots the locking bar 12, such that it is parallel to the door mount retainer assembly 5. The locking bar guide 13 is pressed against the spring 6 and is positioned in the channel of the door mount assembly 5. In this manner, the locking bar guide 13 slides on both the locking bar 12 and the channel of the door mount retainer assembly 5. The spring 6 prevents or resists the locking bar guide 13 from accidentally being released or pushed out of the channel of the door mount assembly 5.

With the locking bar guide 13 at the end of the channel of the door mount retainer assembly 5, which is furthest from the door jamb 2, the locking bar 12 can be used to resist a forced entry against the door 1 by providing leverage to close the door. (Refer to FIG. 3 for this operation.) The base of the locking bar 12, that is closest to the pivot plate 10, can be positioned close to or against the end of the door mount retainer assembly 5 that is closest to the pivot plate 10.

If an operator wishes to allow the door to remain locked, but partially opened so as to have a view to the outside of the door, the locking bar guide 13 can be positioned at the end of the channel of the door mount retainer assembly 5 that is closest to the pivot plate 10. (Refer to FIG. 2 for this operation.) In this manner, as the door opens the locking bar guide 13 slides along the locking bar 12 until it reaches the T-headed, terminal end of the locking bar 12. At this point the door does not open any farther and a solid piece of metal holds the door fast to the door jamb 2. To prevent a leverage action occurring on the pivot plate 10 at its rivet 9 when force is applied to the door with the lock in this position, the pivot plate 10 can be mounted flat against the base plate 8 such that little or no space exists between the two pieces of metal forming the pivot plate 10 and the base plate 8. Another embodiment is to have a raised lip (not pictured) about which the pivot plate 10 is rotated such that the pivot plate 10 is flat against this raised lip.

If a potential intruder is attempting to apply force against the door, one on the inside of the door can push against the door such that the locking bar guide 13 begins to slide down the locking bar 12 towards the pivot plate 10. As progress is made against the force of the intruder, the locking bar 12 can itself be used a lever to push against the door mount assembly 5 and assist in closing the door. (Refer to FIG. 4 for this operation.) As the door is pushed against an intruder and the locking bar 12 again becomes approximately parallel to the door mount retainer assembly 5, the locking bar guide 13 can once again be positioned along the channel of the door mount assembly 5, that is furthest away from the pivot plate 10. In this manner, the locking bar 12 again holds the door in a closed or nearly closed position.

To disengage the pivoting bar lock, in the locking bar guide 13 is slid past the spring 6 such that it leaves the channel of the door mount retainer assembly 5. (Refer to FIG. 6 for this operation.) The locking bar 12 can then be released and rotates about the rivet 9 so that is hangs downwardly from the rivet 9. A lip or edge can be placed on the base plate 8 to prevent the locking bar 12 and the locking bar guide 13 from scraping against the wood trim 4. This lip can hold the locking bar 12 at a slight angle from the wood trim 4. An alternative embodiment is displayed in FIG. 7 wherein part of the wood trim 4 is cut away at an angle to allow the locking bar 12 to hang downwardly.

To install the pivot bar lock, the door mount retainer assembly 5 must be affixed to the door 1 as shown in FIG. 8. The closed end of the channel of the door mount retainer assembly 5 is pointed towards the door jamb edge of the door 1. Wood screws 14 or other fastening means can be used to affix the door mount retainer assembly 5 to the door 1. Placement of the base plate 8, which is affixed by the rivet 9 to the locking bar 12, is facilitated by removing a section of the wood trim 4 enough to allow the base plate 8 to be placed against the solid wood of the door frame stud. Again, wood screws 14 or other fastening means can be used to affix the base plate 8 to the door jamb 2. Proper assembly requires that the fastening means be firmly attached to solid wood, concrete, metal, or other material forming the door jamb 2 or wall. In the embodiment shown in FIG. 6, holes 15 are placed in the pivot plate 10 so that the screws 14 can affix the base plate 8 to the door jamb 2. Alternative embodiments having the fastening means farther away from the rivet 9 or center of the base plate 8 can also be used.

Various embodiments of this invention can be made. For example, a rod like metal part can be used to form the locking bar 12. Shapes other than a T-head shape can also be used to prevent the locking bar guide from sliding off the locking bar 12. For maximum effectiveness this pivoting bar lock can be made of a high quality steel, however, other metals such as brass are effective in making a lock. It is also possible to have an embodiment in which a pivot plate is positioned on the door and a locking bar guide is affixed to a metal component on the door jamb (not shown). In such an embodiment, the shaping of the locking bar guide or the affixing of the pivot plate to the door requires a design that allows the door to be opened to a partially opened position and allows the locking bar to slide through the locking bar guide. It is the intention of the locking bar to resist attack from wire cutters or bolt cutters that might easily defeat the purpose of another device such as a chain lock.

What is claimed is:

1. A door lock for securing a door to a jamb comprising:

(a) a door mount retainer suitable for attachment to said door;

(b) a locking bar; and (c) a locking guide slidably affixed on said locking bar for locking and applying leverage to close said door against said jamb, said locking bar being adapted to be rotatably affixed at a first end to said jamb of said door and removably affixed at a second end to said door mount retainer, said door mount retainer being adapted to detachably engage said locking bar guide.

2. The lock of claim 1, wherein said locking bar is rotatably affixed to a base plate, said base plate being attachable to said jamb.

3. A door lock comprising:

(a) a base plate suitable for attachment to a jamb;

(b) a pivoting means for rotating a locking bar attached to said base plate;

(c) a locking bar guide which is slidably affixed to said locking bar; and (d) a door mount retainer suitable for attachment to a door and being adapted to detachably engage said locking bar guide, said locking bar guide being adapted to slide in a slot in said door mount retainer whereby said door is selectively held in one of two conditions, a first condition being in a closed position and a second condition being in a partially opened position.

4. The lock of claim 3, wherein a spring is mounted in said door mount retainer and shaped to retain said locking bar guide in said door mount retainer.

5. The lock of claim 3, wherein said locking bar guide has a T-shaped portion, a head of said T-shaped portion being adapted to removably slide in said slot of said door mount retainer.

6. A lock for securing a door to a jamb comprising:

(a) a door mount retainer suitable for attachment to said door;

(b) a locking bar; and (c) a locking bar guide slidably affixed on said locking bar for locking and applying leverage to close said door, said locking bar being adapted to be affixed at a first end to said jamb and removably affixed at a second end to said door mount retainer whereby said door is selectively held in one of two conditions, a first condition being a closed position and a second condition being a partially opened position, said door mount retainer being adapted to detachably engage said locking bar guide.

7. The lock of claim 6, wherein said locking bar is affixed to a base plate, said base plate being adapted to be affixed to said jamb.

8. The lock of claim 7, wherein a spring is mounted to said door mount retainer and shaped to retain said locking bar guide to said door mount retainer when said locking bar guide is detachably engaged to said door mount retainer.

9. The lock of claim 8, wherein said locking bar guide has a T-shaped portion, a head of said T-shaped portion being adapted to detachably engage said door mount retainer.

* * * * *